US005087931A

United States Patent [19]

Rawson

[11] Patent Number: 5,087,931

[45] Date of Patent: Feb. 11, 1992

[54] PRESSURE-EQUALIZED INK TRANSPORT SYSTEM FOR ACOUSTIC INK PRINTERS

[75] Inventor: Eric G. Rawson, Saratoga, Calif.

[73] Assignee: Xerox Corporation, Stamford, Conn.

[21] Appl. No.: 523,624

[22] Filed: May 15, 1990

[51] Int. Cl.[5] ..... B41J 2/04; B41J 2/175

[52] U.S. Cl. ..... 346/140 R

[58] Field of Search ..... 346/140, 75, 140 R; 400/202.2

[56] References Cited

U.S. PATENT DOCUMENTS 4,568,953 2/1986 Aoki et al. ..... 346/140 R
4,751,529 6/1988 Elrod et al. ..... 346/140 R
4,801,953 1/1989 Quate ..... 346/140 R
4,882,595 11/1989 Trueba et al. ..... 346/140 R

*Primary Examiner*—Benjamin R. Fuller
*Assistant Examiner*—Alrick Bobb
*Attorney, Agent, or Firm*—Townsend and Townsend

[57] ABSTRACT

An ink transport system for an acoustic ink printer having an array of ejectors with associated ink bodies and free surfaces. The ink transport system supplies ink to the injector ink bodies constantly, yet zeros the hydrostatic gauge pressures of the free surfaces of the ink bodies to ensure uniformity of ejector performance. The ink transport system works with linear and two-dimensional arrays of ejectors.

34 Claims, 5 Drawing Sheets

PRESSURE-EQUALIZED INK TRANSPORT SYSTEM FOR ACOUSTIC INK PRINTERS

BACKGROUND OF THE INVENTION

The present invention relates to acoustic ink printers, and, more particularly, to ink transport systems for such printers.

In acoustic ink printing an array of ejectors, forming a printhead, is covered by pools of liquid ink. Each ejector can direct a beam of sound energy against a free surface of the liquid ink. The impinging acoustic beam exerts radiation pressure against the surface of the liquid. If the radiation pressure is sufficiently high, individual droplets of ink are ejected from the liquid surface to impact upon a sheet of medium, such as paper, to complete the printing process.

Typically, the ejectors are arranged in a linear array so that the ejectors are aligned perpendicularly to the movement of the recording medium which receives the ejected ink droplets. Alternatively, the ejectors may be arranged in an array of rows and columns, with the rows stretching across the width of the recording medium and the columns of ejectors approximately perpendicular along the movement of the recording medium. Often the columns of ejectors are not arranged exactly perpendicular to the ejector rows, but at oblique angles with the rows. In other words, the ejector rows of the array are staggered.

Each ejector for an acoustic ink printer must be supplied with ink and a good ink supply system should maintain a flow of ink constantly. A flowing ink supply system cools the ink and stabilizes the ink temperature more easily. Additionally, the flowing ink supply system keeps the ink free of various contaminants, such as paper dust which might settle upon the free surfaces of the ink, by sweeping the contaminants away. The constantly flowing ink also maintains fresh ink to the free surfaces. Without the constant flow of ink, the differing evaporation rates of the constituents within the ink may adversely affect the uniformity of the ink composition associated with each ejector and therefore, the uniformity of performance of the ejectors.

Ideally, each ejector when activated ejects an ink droplet identical in size to the droplets of all the other ejectors in the array. Thus, each ejector should operate under identical conditions.

One problem which arises particularly with an ink supply of flowing ink is the equalization of the hydrostatic pressure of the free surfaces associated with each ejector. Equalization may be relatively simple with a small number of ejectors, but as the number of ejectors increases in higher-performance and higher-resolution printers, the ink supply system for delivering ink to the ejectors becomes more complex and the equalization of pressure at each ejector more difficult. For example, acoustic ink printers having resolutions finer than 300 dots per inch, the present standard for laser printers, are now under consideration with the attendant problems of complexity in the ink transport system. Nonetheless, despite the increased complexity, the ink supply system must maintain equal hydrostatic pressures at the free surfaces of each ejector.

The present invention solves or substantially mitigates this problem of hydrostatic pressure equalization of the free surfaces of each ejector in an acoustic ink printer with an ink transport system which maintains the ink under constant flow.

SUMMARY OF THE INVENTION

For an acoustic impact printer having a set of ejectors and an ink body associated with each ejector, the present invention provides for an ink transport system in which each ink body is supplied with ink in parallel with the other ink bodies.

For a linear array of ejectors, the ink transport system has an input manifold aligned parallel to the ejector array. The input manifold has a plurality of openings, each opening corresponding to one of the ejectors. The ink supply system has an output manifold which is also parallel to the ejector array and similarly has a plurality of openings, with each opening corresponding to one of the ejectors. Between each opening in the input and output manifolds there is a transverse conduit, each conduit coupled to one of the ejectors. Each transverse conduit has an opening which defines the free surface associated with its ejector.

The input and output manifolds are designed so that the fluidic resistance defined between two adjacent openings in the input manifold is identical to the fluidic resistance defined between the corresponding two adjacent openings in the output manifold. This is done by making the physical parameters of the two manifolds identical. Additionally, the transverse conduits are designed so that the fluidic resistance defined between an input manifold opening and the opening defining the corresponding ejector's free surface and the fluidic resistance defined between the opening and the output manifold opening are equal. Furthermore, adjacent ends of the parallel input and output manifolds are each connected to an ink supply source at a particular pressure. In this manner, the hydrostatic pressure at each free surface is equalized.

To keep the variation of ink flow rates through different branches of the transport system within a predetermined range, the fluidic resistances of the input and output manifolds are much smaller compared to the fluidic resistances of the transverse conduits.

The present invention also ensures that the hydrostatic pressure at each free surface is at ambient pressure, i.e., the gauge pressure at each free surface is zero, by having the input gauge pressure at which the ink is introduced into the input manifold and the output gauge pressure at which the ink is removed from the output manifold equal in magnitude but opposite in sign.

Furthermore, if the input gauge pressure is applied at both ends of the input manifold and likewise, the output gauge pressure at both ends of the output manifold, the variation of ink flow rates through the different branches of the ink transport system is also reduced.

The present invention also allows the transverse conduits between the parallel input and output manifolds to be replaced by a single transverse conduit which is coupled to all of the ejectors in a linear array. With the dimensions of the transverse conduit and input and output manifolds appropriately set, ink flows from the input manifold to the output manifold as a sheet of ink with a minimal amount of ink flow along the direction of the ejector axis.

The present invention also provides for two-dimensional ejector arrays with zero hydrostatic gauge pressures for the free surfaces of the array. The ink transport system of the present invention has a primary input manifold and output manifold which are aligned with the ejector rows. The primary input and output manifolds are connected to secondary input and output manifolds which are aligned with the ejector columns. Transverse conduits connect the secondary input and output manifolds of each ejector column, one conduit for each ejector.

To obtain zero gauge pressures at each of the free surfaces associated with the ejectors, the primary input and output manifolds are designed so that the fluidic resistance defined between adjacent openings of the primary input manifold are equal to the fluidic resistance defined between the corresponding adjacent openings of the primary output manifold. Similarly, the fluidic resistances defined between the openings in the secondary input manifolds are equal to the fluidic resistances defined between the corresponding openings in the corresponding secondary output manifolds. Additionally, the fluidic resistance defined by a secondary input manifold opening and the opening defining the free surface for the corresponding transverse conduit is equal to the fluidic resistance defined between the opening and the secondary output manifold opening for each transverse conduit.

BRIEF DESCRIPTION OF THE DRAWINGS

A clear understanding of the present invention may be achieved by a perusal of the following Detailed Description of Specific Embodiments and the following drawings.

DESCRIPTION OF PREFERRED EMBODIMENTS

As mentioned above, it is desirable that an ink transport system for an acoustic ink printer move the ink constantly through the system. Each ejector of the printer has an associated body of ink with a free surface from which ink droplets are ejected upon a medium. It is important that the free surfaces of each ejector have zero hydrostatic gauge pressures for the uniformity of the droplets and the quality of printing of each ejector. Gauge pressure is pressure defined with respect to the atmospheric pressure.

In an ink transport system under pressure to move the ink through the system constantly, the uniformity in hydrostatic pressure is a problem. As the number of ejectors (and free surfaces) increases for better resolution and performance, systematic differences in hydrostatic pressures at different ejectors arise due to the different paths followed by the ink moving through the system and correspondingly different pressure drops for fluid flows to different ink bodies. In a high density printhead for an acoustic printer having, say, a two-dimensional array of hundreds of columns by several rows of ejectors, the hydrostatic pressure imbalances among the ink bodies may cause the level of free surfaces of ink bodies to vary substantially. Such variations cause adverse effects upon droplet uniformity.

On the other hand, the present invention enables a first-order equalization and zeroing of ink body gauge pressures at all the ejectors. The present invention achieves this equalization and zeroing by supplying the ink bodies and associated free surfaces with ink in parallel and by assuring that all gauge pressure differences between points in the input portion of the ink supply system and corresponding points in the output portion are equal in magnitude but opposite in sign.

Figure 1:
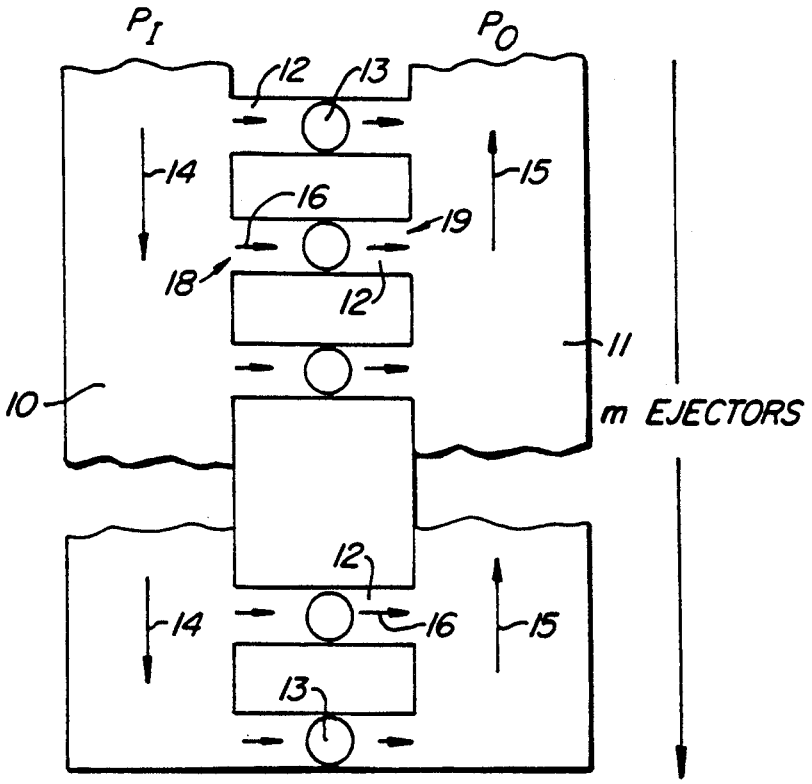
FIG. 1 is a top view representation of an ink transport system for a linear array of ejectors according to the present invention.

FIG. 1 is a top view representation of an ink supply system for a linear array according to the present invention. An input manifold 10 for supplying ink to a linear array of free surfaces 13 is parallel to an output manifold 11. The input manifold 10 has a plurality of openings 18. Each opening 18 corresponds to one of the free surfaces 13. Similarly there are openings 19 in the output manifold 11 for each free surface 13. A transverse conduit 12 connects each input manifold opening 18 to its corresponding output manifold opening 19 so that the corresponding free surface 13 is also connected.

Arrows 14 show the direction of ink flow in the input manifold 10, arrows 15 show the ink flow direction in the output manifold 11, and arrows 16 show ink flow in the transverse conduits 12. The ink is introduced into one end of the input manifold 10 under a steady gauge pressure $P_I$ and removed from the output manifold 11 at one end under a steady gauge pressure $P_O(=-P_I)$. These pressures are symbolically indicated at the top of FIG. 1. Furthermore, the parameters and operating conditions of the ink supply system are set so that the ink flows through the system are laminar.

These conditions permit a complex ink transport systems, such as shown in FIG. 1, to be analyzed by using electrical circuit analogs. Under the present invention, the input and output gauge pressures $P_I$, $P_O$ are constant and the ink is in a steady state flow condition. All flow impedances are real and not complex, i.e., capacitive and inductive reactances to fluid flows do not affect the steady state ink flow or the resulting steady state free surface pressure.

Figure 2A:
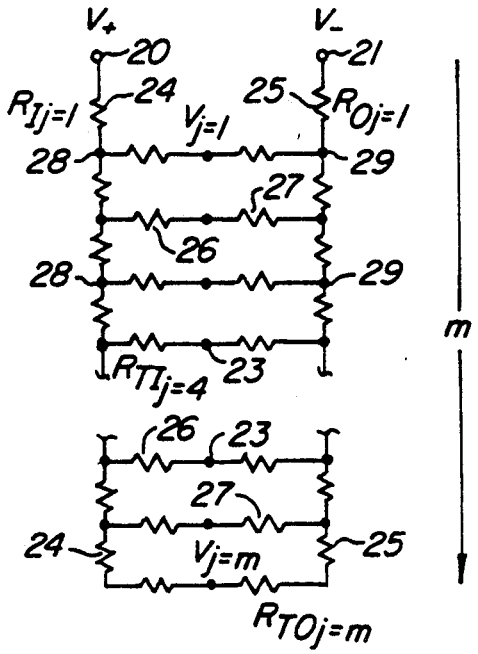
FIG. 2A is an electrical circuit diagram which is analogous to the fluidic circuit shown in FIG. 1.

FIG. 2A is an electrical circuit analogous to the ink transport system of FIG. 1. Following K. Foster and G.A. Parker, *Fluidics: Components and Circuits*, Wyley-Interscience, John Wyley and Sons, London, 1970, the fluidic resistance through a channel is defined as $$R = \frac{P}{W}$$

where P is the pressure difference between the two ends of the channel in dynes/cm$^2$, and W is the volume flow rate through the channel in cm$_3$/sec. Thus the units of the channel resistance are gm/(sec.-cm<). The channel lengths channel resistance are gm/(sec.−cm$^4$). The channel lengths L are assumed to be sufficiently large so that end effects can be ignored.

With these assumptions, the fluidic resistance of various channel shapes for the various manifolds and transverse conduits in an ink transport system can be calculated. Such calculations are described in attached Appendix A.

Returning to the analysis of an ink transport system by electrical analogy, the ink flow resistance is represented by electrical resistance, ink flow itself is represented by electrical current, and fluid pressure by electrical voltage. Ground potential, i.e., zero voltage, corresponds to local atmospheric pressure. Thus gauge pressure is also represented by voltages with respect to ground.

In the circuit of FIG. 2A, the openings 18 of the input manifold 10 are represented by nodes 28. The fluidic resistance between the openings 18 are represented by resistors 24 with resistances $R_I$ for j=1 to m. Similarly the output manifold openings 19 are represented by nodes 29 and the fluidic resistances between the nodes 29 by resistors 25 with resistances $R_o$ for j=1 to m. The input pressure $P_I$ on the input manifold 10 is analogized by voltage $V_+$ and the output pressure $P_o$ on the output manifold 11 by $V_-$.

The transverse conduits 12 have electrical circuit branch analogues between the nodes 28, 29. Nodes 23 represent the location of the free surfaces 13. Resistors 26 with resistances $R_{TIj}$, j=1 to m, are analogous to the fluidic resistances between the input manifold openings 18 and the free surfaces 13 and resistors 27 with resistances $R_{TOj}$, j=1 to m, are analogous to the fluidic resistances between the free surfaces 13 and the output manifold openings 19.

To equalize and zero the hydrostatic gauge pressures at the free surfaces 13, the analogous voltages $V_i$ for j=1 to m at each node 28 in the circuit of FIG. 2A are equal and zero. Such an equality occurs if each analogous input manifold resistance $R_{Ij}$ are equal to its corresponding output manifold resistance $R_{Oj}$ and each analogous input fluidic resistance $R_{TIj}$ for a transverse conduit is equal to the corresponding output fluidic resistance $R_{TOj}$ of that transverse conduit. Thus the hydrostatic pressure at each free surface 13 is equalized. This can be seen by analyzing each branch of the circuit in FIG. 2A iteratively. The voltages $V_j$ are zero because the $V_+$ and $V_-$ are equal in magnitude and opposite in sign.

While, in principle, the input manifold resistances $R_{Ij}$ need not be equal to each other, nor need the output manifold resistances $R_{Oj}$ be equal, the input manifold 10 is fabricated in practice so that the fluidic resistances between the openings 18 are equal to one another. The output manifold 11 is also fabricated so that not only the fluidic resistances between the openings 19 equal to one another, but also equal to the resistances of the input manifold 18. This is achieved with the channel sections between the openings 18 in the input manifold 10 and the channel sections between the openings 19 in the output manifold 11 fabricated with equal dimensions, i.e., with channels of constant cross-section and equally spaced openings.

In passing, it should be noted that principle also allows one to choose the input manifold resistances $R_{Ij}$ and the output manifold resistances $R_{Oj}$ so that the currents through transverse conduits between the two manifolds could be equal. However, the complexities in making the input and output manifolds with say, tapering channels seriously affect the practicality of fabrication of such manifolds.

Likewise, while in principle the fluidic resistances of the transverse conduits 12 need not be equal, in practice the conduits 12 are fabricated with identical dimensions so that all the fluidic resistances of the transverse conduits 12 are equal.

As shown in FIG. 1, the input manifold 10 is connected at one end to a pressure source at $P_I$ and the output manifold 11 is connected at one end to another pressure source at $P_O$. The ends of the input and output manifolds 10, 11 are adjacent to one another. It should be noted that due to the drop in pressure along the input manifold 10 and output manifold 11, the pressure differences between the input and output openings 18, 19 are smaller for the openings removed from the two pressure sources. Thus the ink flow rates past the removed free surfaces will be lower than for those nearer the pressure sources. However, the ink transport system for any acoustic ink printer should provide some ink movement at the free surfaces at all the ejectors.

By setting dimensions of the input and output manifolds 10, 11 large compared to the dimensions of the transverse conduits 12, the fluidic resistances of the manifolds 10, 11 are much lower than the resistances of the conduits 12. In fact, as the equations in Appendix A show, the resistance of a rectangular channel varies inversely as the square of its cross-sectional area. Thus the pressure drops along the manifolds 10, 11 are a small fraction of the total pressure drop. The resulting pressure differences between the openings 18, 19 are small and the variations in flow rates through the transverse conduits 12 are thereby reduced.

Figure 2B:
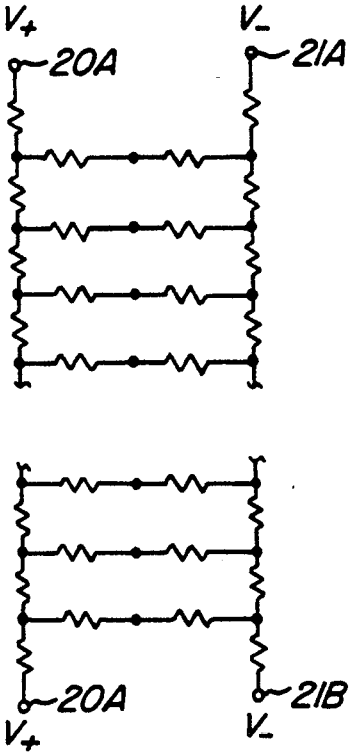
FIG. 2B is a variation of the electrical circuit shown in FIG. 2A.

FIG. 2B is a variation of the electrical analogue of FIG. 2A. It illustrates the point that if the FIG. 1 input manifold 10 at two ends is connected to a first ink supply source under pressure and that the output manifold 11 at its two ends is also connected to a second ink supply source under pressure, variation in fluid flow is also reduced. A simple analysis of the circuit of FIG. 2B shows that if the two ends of the input manifold 10 are connected to the pressure source at $P_I$ and the two ends of the output manifold 11 connected to the second pressure source at $P_O$, the variations in ink flow rates among the transverse channels are reduced. Alternatively, twice as many ejectors can be supported with no increase in the variations in the ink flow rates as compared to the ink supply system represented by FIG. 2A.

Furthermore, by choosing particular values for input gauge pressure $P_I$ and output gauge pressure $P_O(=-P_I)$, the ink flow rates through the ink transport system can be set at any value subject to the restriction that the difference in pressures is not so high that laminar flow does not occur.

Figure 3:
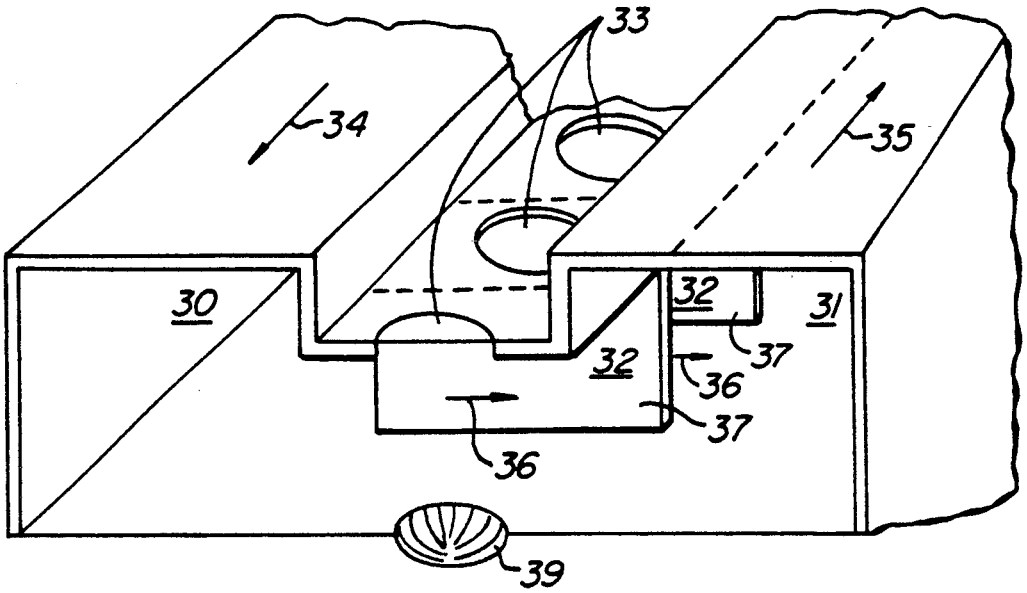
FIG. 3 is a cross-sectional and perspective view of an input manifold, an output manifold and a transverse conduit according to the present invention.

FIG. 3 is a cross-sectional and perspective view of an ink transport system according to the present invention. An input manifold 30 is connected to an output manifold 31 by transverse conduits 32. Arrows 34 and 35 respectively indicate the flow direction of the ink in the input manifold 30 and the output manifold 31, while arrows 36 show ink flow direction in the conduits 32.

Each transverse conduit 32 is associated with a single ejector. In FIG. 3 the ejector is shown by its corresponding opening 33 and by a spherically concave acoustic lens 39. The acoustic lens 39 is on the top surface of a substrate which has an acoustic velocity much greater than the acoustic velocity for the liquid ink. On the bottom surface of the substrate directly below the lens 39 a piezoelectric transducer is attached. None of this is shown in drawings, but an ejector structure useful in the present invention is detailed in U.S. Pat. No. 4,751,529, issued on June 14, 1988 to S. A. Elrod et al. and assigned to the present assignee.

With each ejector and corresponding transverse conduit 32 there is an associated aperture to expose a free surface 33 of the body of ink in the conduit 32. In operation acoustic waves from the transducer travel through the substrate to the acoustic lens 39, which focuses the acoustic energy at or near the free surface 33. With sufficient acoustic radiation pressure to overcome surface tension, a droplet of ink is ejected upwards from the free surface 33 to impact upon a medium to complete the printing process.

To increase the linear density of the ejectors, the transverse conduits 32 are not spaced apart as represented in FIG. 1. Instead, the conduits 32 are separated by planar dividers 37. The planar dividers 37 also introduce some flexibility. For example, if the linear density is kept constant and the planar dividers 37 are thickened, the fluidic resistances of transverse conduits 32, which should be much larger that those of the input and output manifolds 30, 31, are increased. As evident from the drawings the cross-sectional dimensions of the input and output manifolds 30, 31 are much larger that those of the conduits 32.

In linear arrays of 32 ejectors with a density of 75 per inch, input manifolds having heights of 0.3 mm and widths of 0.3 mm are believed to work well with transverse conduits having heights of 0.030 mm and widths of 0.060 mm. Input and output pressures of $+1$ and $-1$ mm of $H_2O$ respectively are suitable for such ink supply systems.

Another embodiment of the ink transport system is a system in which the transverse conduits are merged into one so that the ink flows in a sheet from the input manifold to the output manifold past the linear array of ejectors and their openings. For example, the system shown in FIG. 4 without the dividers 37 of system of FIG. 3 is illustrative of such a system.

Figure 4:
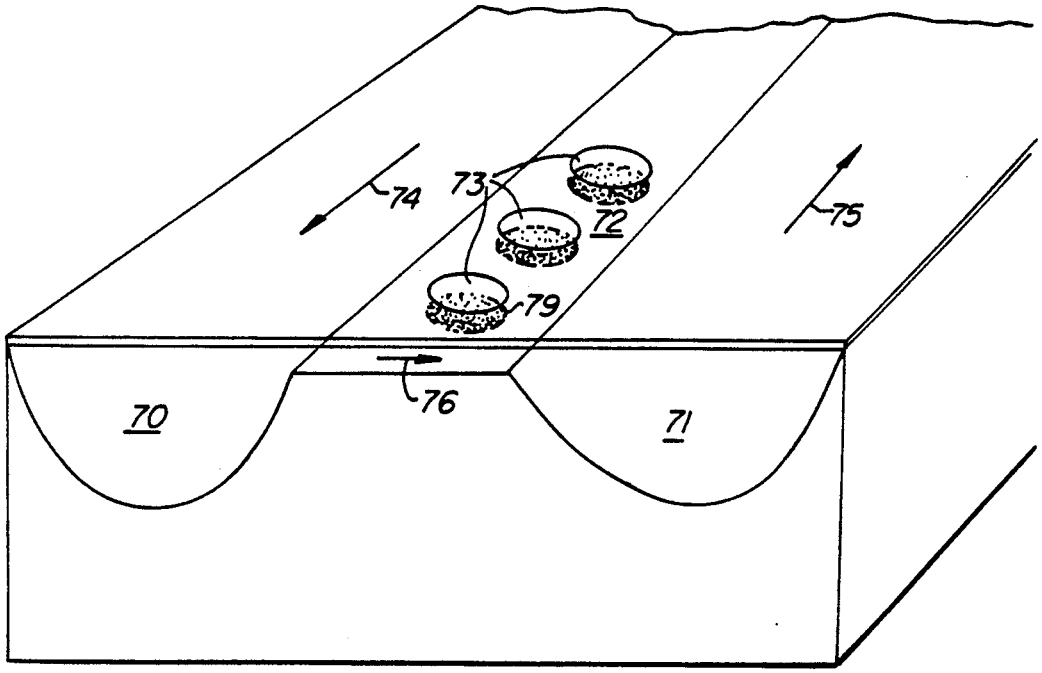
FIG. 4 is a cross-sectional and perspective view of an input manifold, an output manifold and a transverse conduit in the form of a sheet according to the present invention.

In FIG. 4 an input manifold 70 supplies ink to a linear array of ejectors, each ejector shown by its corresponding opening 73 and by a spherically concave acoustic lens 79. An output manifold 71, in the same half-cylindrical channel shape as the input manifold 70, removes ink from the ejectors. Instead of a plurality of transverse conduits, there is one transverse conduit 72 connecting the parallel input and output manifolds 70, 71. Through an elongated opening which is coextensive to the array of ejectors, the ink flows from the input manifold 70 to the output manifold 71 through another elongated opening which is coextensive to the ejector array. Arrows 74, 76 and 75 show ink flow in the input manifold 70, transverse conduit 72 and output manifold 71 respectively.

The transverse resistances, i.e., the fluidic resistance of the "sheet" transverse conduit 72, are sufficiently high relative to the resistances in the input and output manifolds 70, 71 so that lateral ink flow in the transverse conduit 72 along the linear array axis is minimized. In other words, even without separate transverse conduits, the ink flow remains transverse between the input and output manifolds. A realization of these conditions is achieved generally by making the cross-sectional dimensions of the input and output manifolds large with respect to the height of the transverse conduit.

Figure 5:
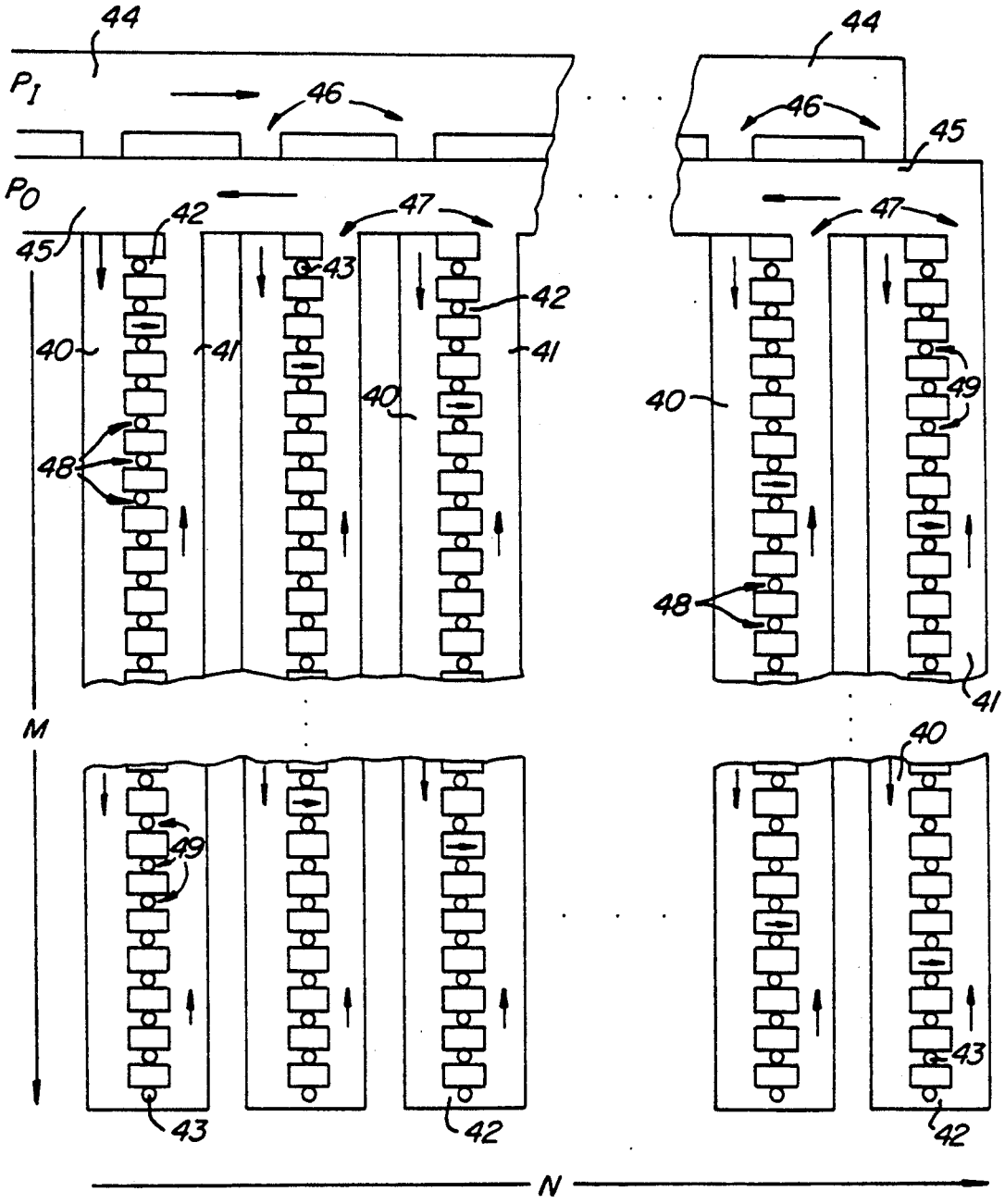
FIG. 5 is a top view representation of an ink transport system for a two-dimensional array of ejectors according to present invention.

The present invention also permits the equalization and zeroing of gauge pressures in two-dimensional arrays of ejectors. FIG. 5 is a representation of a two-dimensional array in which the arrangement of FIG. 1 is applied twice.

FIG. 5 depicts an ink transport system for a two-dimensional array with an arbitrary number of rows and columns of ejectors. MxN free surfaces 43 are arranged in M rows by N columns. A primary input manifold 44 under input gauge pressure $P_I$ supplies ink to N secondary input manifolds 40 through openings 46. Each of the secondary input manifolds 40 corresponds to and is parallel to one of the N columns of the free surfaces 43 (and associated ejectors). Adjacent to each free surface 43 the corresponding manifold 40 has an opening 48 through which ink is supplied to the ink body for the free surface 43.

The ink transport system also has a primary output manifold 45 under output gauge pressure $P_O$. Like the primary input manifold 44, the primary output manifold 45 has N openings 47 for connection to secondary output manifolds 41 which correspond to and are parallel to each of the columns of free surfaces 43. Each secondary output manifold 41 has M openings 49, each of which corresponds to and is adjacent to a free surface 43 in the column.

Between each secondary input and output manifold opening 48, 49, there is a transverse conduit 42 which has an opening to define the free surface 43 for the corresponding ejector.

The straight arrows indicate the flow of ink through the transport system in FIG. 5. Ink is supplied under input gauge pressure $P_I$ to the primary input manifold 44, which supplies the ink to each of the secondary input manifolds 40. Each secondary input manifold 40 supplies ink to its corresponding row of free surfaces 43 and ejectors by the transverse conduits 42 for the row of free surfaces 43. The secondary output manifold 41 associated with the column removes the ink from the conduits 42. From the manifolds 41 the primary output manifold 45 gathers the ink under output gauge pressure $P_O$.

Figure 6:
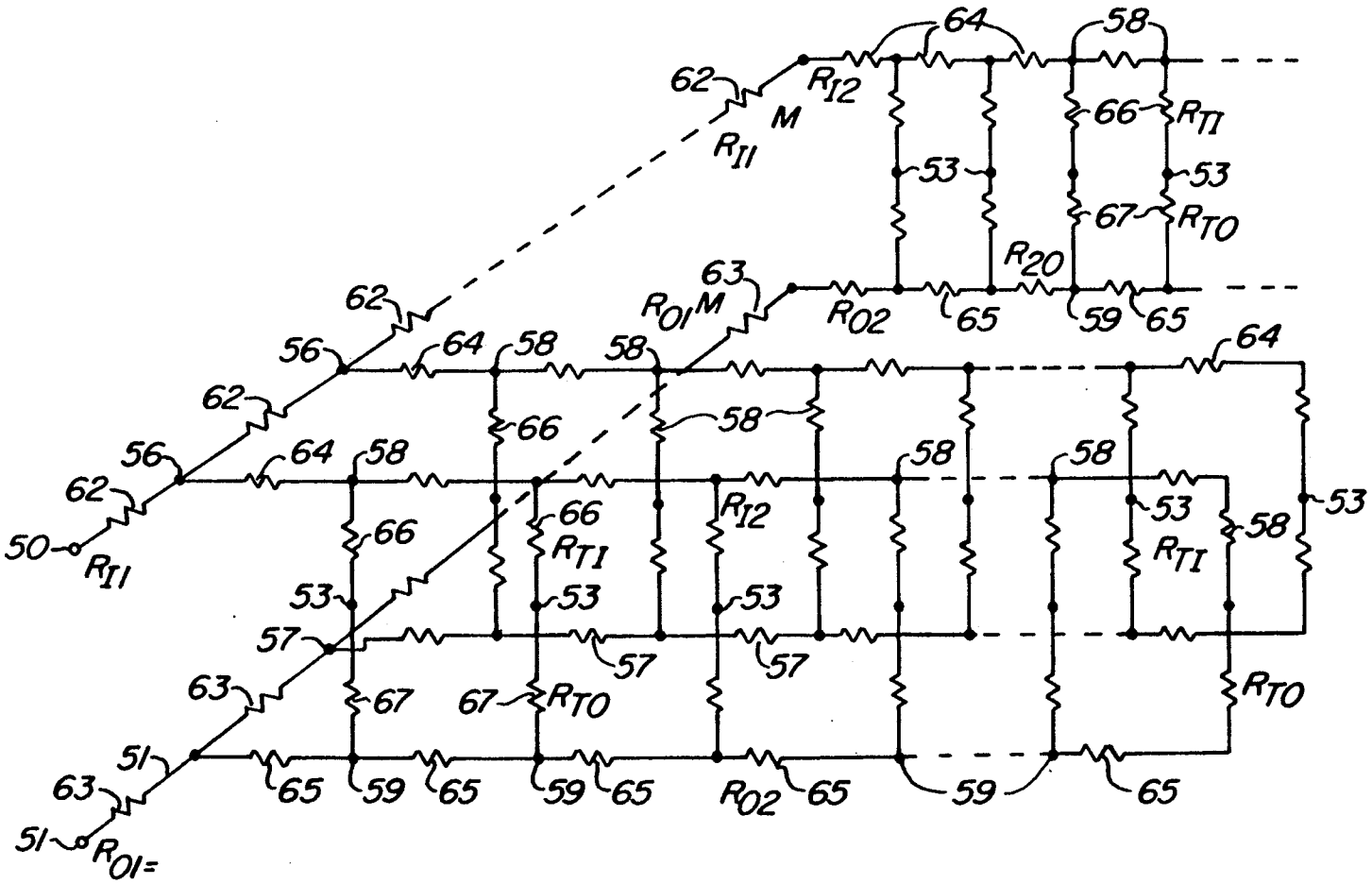
FIG. 6 is an electrical circuit diagram which is analogous to the fluidic circuit shown in FIG. 5.

By again referring to an electrical analogue of this ink transport system as in FIG. 6, the requirements for equalizing zeroing the hydrostatic gauge pressures at the free surfaces 43 can be found. The circuit in FIG. 6 can be analyzed by performing the analysis of the FIG. 2A circuit in hierarchial fashion.

The openings 46 in the primary input manifold 44 are represented by nodes 56 in FIG. 6 and the fluidic resistances between the openings 46 by resistors 62 having resistances $R_{Ilk}$ for $k=1$ to N. The openings 47 in the primary output manifold 45 are analogized by nodes 57 and the fluidic resistances between the openings 47 by resistors 63 having resistances $R_{Ilk}$ for $k=1$ to N.

The input gauge pressure $P_I$ on the primary input manifold 44 is again analogized by the voltage $V_+$ on an input terminal 50 and the output gauge pressure $P_O$ on the primary output manifold 45 analogized by the $V_-$ on an output terminal 51.

In the circuit of FIG. 6, each node 56 analogous to the openings 46 in the primary input manifold 44 is connected to a string of resistors 64 having resistances $R_{12jk}$ for $j=1$ to M and $K=1$ to N. The resistors 64 analogize the fluidic resistances between the openings 48, which are in turn analogized by nodes 58 in the secondary input manifolds 40. Likewise, the secondary output manifold openings 49 are analogized by nodes 59 and resistors 65 with resistances $R_{O2jk}$ for $j=1$ to M and $k=1$ to N analogize the fluidic resistances in the secondary output manifolds 41 between the openings 49.

The transverse conduits 42 have electrical circuit branch counterparts analogues between the nodes 58, 59. Nodes 53 analogize the free surfaces 43, while resistors 66 with resistances $R_{TIjk}$, j=1 to M and k=1 to N analogize the fluidic resistances between the secondary input manifold openings 48 and the free surfaces 43, and resistors 67 with resistances $R_{TOjk}$, j=1 to M and k=1 to N analogize the fluidic resistances between the free surfaces 43 and the secondary output manifold openings 49.

To equalize the hydrostatic gauge pressures at the free surfaces 43, the analogous voltages $V_{jk}$ for j=1 to M and k=1 to N at each node 53 in the circuit of FIG. 5 should be equal. Such an equality occurs if each analogous primary input manifold resistance $R_{I1j}$ is equal to its corresponding analogous primary output manifold resistance $R_{O1j}$; each analogous secondary input manifold resistance $R_{I2jk}$ is equal to its corresponding analogous secondary output manifold resistance $R_{O2jk}$, and each analogous input fluidic resistance $R_{TIjk}$ of a transverse conduit 43 is equal to the output fluidic resistances $R_{TOjk}$ of that transverse conduit. Thus if the analogous fluidic resistances of the ink transport system represented in FIG. 5 are accordingly equalized, the hydrostatic pressure at each free surface 43 is equalized. Furthermore, to zero the hydrostatic gauge pressures at the free surfaces 43, it is only necessary that the input and output gauge pressures, $P_I$ and $P_O$, are of equal magnitude and of opposite sign.

Again in practice, the primary input and output manifolds 44, 45 are fabricated so that the fluidic resistances defined between the openings 46, 47 are equal; the secondary input and output manifolds 40, 41 fabricated so that the fluidic resistances defined between the openings 48,49 are equal; and all the fluidic resistances of the transverse conduits 42 are equal. The primary input and output manifolds 44, 45 are fabricated with equal channel dimension, the secondary input and output manifolds 40, 41 fabricated with equal channel dimensions, and the transverse conduits 42 with equal channel dimensions.

Other details from the ink transport system for the linear array, such as reduction in ink flow variations, can also be applied to the system for the two-dimensional array. For example, the FIG. 5 primary input and output manifolds 44, 45 can be connected at both their ends to a first ink supply source at $P_I$ pressure and a second ink supply source at $P_O$ pressure, respectively. Additionally, a second pair of input and output manifolds could be attached to all the secondary input and output manifolds, respectively, at their second ends. Finally, these two primary input manifolds and two primary output manifolds, in turn, could be connected at both ends of the primary manifolds to the ink supply sources as explained previously.

Additionally, as discussed in the case of a linear array of ejectors without separate transverse conduits, the two-dimensional array may also be adapted so that each column of ejectors is no longer supplied by separate transverse conduits associated with each ejector, but rather by a sheet of ink between the secondary input and output manifolds.

While the description above provides a full and complete disclosure of the preferred embodiments of the present invention, various modifications, alternate constructions and equivalents may be employed without departing from the true scope and spirit of the invention. For example, while the two-dimensional array of ejectors in FIG. 5 was illustrated with rows and columns aligned in both directions, a two-dimensional array having rows which are staggered may also be constructed without necessarily departing from the present invention. Therefore, the present invention should be limited only by the metes and bounds of the appended claims.

APPENDIX A

FLUIDIC RESISTANCES FOR VARIOUS CHANNEL SHAPES

Under conditions of constant laminar flow, the fluidic cylindrical channel of radius r and length L can be shown to be (K. Foster and G. A. Parker, *Fluidics: Components and Circuits*, Wiley-Interscience, John Wiley & Sons, London, 1970, ch.2); L. D. Landau and E. M. Lifshitz, *Fluid Mechanics*, Pergamon, London 1959, pp.50–59; and *Handbook of Chem. and Phys.*, CRC Press, 54th Ed., p.F43)

$$R_{cylinder} = \frac{8\,\eta L}{\pi r^4}$$

Similarly, the fluidic resistance for a high-aspect ratio (b>h) rectangular channel is $$R_{rectangular} = \frac{3\,\eta L}{4bh^3} \text{ for } b > h$$

where L is the channel length, b is the channel half-width and h is the channel half-height, $\eta$ is the ink's absolute viscosity in poise.

When b is not large compared to h, including the case of a square channel, b=h, $$R_{rectangular} = \frac{3\,\eta L}{4bh^3}\,[1 - h/b\,f(b/h)]^{-1}$$

where $$f(b/h) = \frac{192}{\pi^5} \sum_{n=1}^{\infty} 1/n^5 \tanh(n\pi b/h)$$

Thus, for a square channel of half-width h, f(1.0)=0.6482 and $$R_{square} = 2.132\,\frac{\eta L}{h^4}$$

Note that this resistance is lower than of a cylinder of radius r (since 8/n=2.546). This is as expected, since when h=r, a square of half-width h encloses a circle of radius r.

Another useful channel shape is that of a half-cylinder. The fluidic resistance of this channel shape may be determined by rewriting the fluidic resistance equations for a cylinder and square given above in terms of the cross-sectional area A as follows, $$R_{cylinder} = 8\pi\,\frac{\eta L}{A^2} = 25.13\,\frac{\eta L}{A^2} \text{ and}$$

$$R_{square} = 34.11\,\frac{\eta L}{A^2}$$

Assuming equal cross-sectional areas, the resistances of the cylindrical and square channels are compared and the implications for the resistance of the half-cylinder channel is considered. For equal cross-sectional areas, a cylindrical channel has the lower resistance because a circle has, on the average, more of its cross-sectional area lies at the greatest distance from a channel wall. Based on the relative degree of circularity of the cross-section, it is reasonable to conclude that the resistance of a half-cylinder channel (a circle pulled to two corners) should lie intermediate between the resistances of a cylinder (the optimal circular shape with no corners) and the square channel (a circle pulled to four corners). Thus an estimate of a coefficient of 30 may be made for the half-cylinder of radius r so that $$R_{half\text{-}cylinder} = 30\frac{\eta L}{A^2} = \frac{120\,\eta L}{\pi^2 r^4} = 12.16\frac{\eta L}{r^4}$$

This estimate is believed to be accurate to ±10%. For channel having a cross-section in the shape of an equilateral triangle with a half-side length of a, $$R_{triangle} = \frac{20\,\eta L}{(3)^{\frac{1}{2}}\,a^4}$$

Expressed in terms of the cross-sectional area A, $$R_{triangle} = 20\,(3)^{\frac{1}{2}}\frac{\eta L}{A^2} = 34.64\frac{\eta L}{A^2}$$

The equations above show how fluidic resistances are calculated for particular channel shapes which may useful in constructing an ink transport system for an acoustic ink printer according to the present invention.

What is claimed is:

1. In an acoustic ink printer having a plurality of ejectors aligned in an axis, each ejector associated with a free surface of liquid ink, said ejector radiating acoustic pressure upon said free surface to eject individual ink droplets on demand, a system for transporting ink under flow constantly to said free surfaces comprising:

an input manifold parallel to said ejector axis for supplying ink to said ejectors, said manifold having a first end connected to a first ink supply source at a first predetermined pressure, said manifold having a plurality of openings, each opening corresponding to one of said ejectors, said manifold having a predetermined fluidic resistance between each of two adjacent openings;

an output manifold parallel to said ejector axis for removing ink from said ejectors, said manifold having a first end adjacent to said input manifold first end connected to a second ink supply source at a second predetermined pressure equal in magnitude but opposite in sign to said first predetermined pressure, said manifold having a plurality of openings, each opening corresponding to one of said ejectors, said manifold having a predetermined fluidic resistance between each two adjacent openings, each fluidic resistance between said two adjacent output manifold openings being equal to fluidic resistance between said two corresponding adjacent input manifold openings; and a plurality of transverse conduits, each transverse conduit coupled to one of said ejectors and connected to said input manifold opening and to said output manifold opening corresponding to said ejector, said transverse conduit having an opening defining said free surface associated with said ejector, said conduit having a predetermined input fluidic resistance between said input manifold opening and said transverse conduit opening, and a predetermined output fluidic resistance between said conduit opening and said output manifold opening, said input and output fluid resistances being equal to each other;

whereby hydrostatic gauge pressure at each free surface associated with each ejector is substantially equal and zero.

2. The system as in claim 1 wherein said input and output manifold fluidic resistances are greater than said input and output transverse conduit fluidic resistances.

3. The system as in claim 2 wherein said input manifold, output manifold and transverse conduits have cross-sections, said cross-sections of said input and output manifolds being constant and large relative to said cross-sections of said transverse conduits.

4. The system as in claim 3 wherein said cross-sections of said input and output manifolds are equal to each other.

5. The system as in claim 3 wherein said cross-sections of said transverse conduits are substantially equal to each other.

6. The system as in claim 1 wherein said first and second pressures have a difference such that liquid ink flow in said system is laminar.

7. The system as in claim 1 wherein said input manifold has a second end opposite to said first end, said second end connected to said first liquid ink source at first predetermined pressure, said output manifold has a second end opposite to said first end, said second end connected to said second liquid ink source at said second predetermined pressure, whereby variations in liquid ink flow rates through said system are reduced.

8. In an acoustic ink printer having a plurality of ejectors aligned in an axis, each ejector associated with a free surface of liquid ink, said ejector radiating acoustic pressure upon said free surface to eject individual ink droplets on demand, a system for transporting ink under flow constantly to said free surfaces comprising:

an input manifold parallel to said ejector axis for supplying ink to said ejectors, said input manifold having a first end and a second end opposite said first end, said first end connected to a first liquid ink source at a first predetermined pressure;

an output manifold parallel to said ejector axis for removing ink from said ejectors, said output manifold having a first end and a second end opposite said first end, said first end adjacent said input manifold first end and connected to a second liquid ink source at a second predetermined pressure, equal in magnitude but opposite in sign to said first predetermined pressure; and a transverse conduit coupled to at least one of said ejectors and connected to said input manifold and to said output manifold, said transverse conduit having at least one opening defining said free surface associated with said ejector;

said input manifold having a fluidic resistance defined between said first end and said transverse conduit, said output manifold having a fluidic resistance defined between said first end, said transverse conduit having input and output fluidic resistances, said input fluidic resistance defined between said input manifold and said opening, said output fluidic resistance defined between said opening and said output manifold, the sum of said input manifold fluidic resistance and said transverse conduit input fluidic resistance being equal to the sum of said output manifold fluidic resistance and said transverse conduit output fluidic resistance;

whereby hydrostatic gauge pressure at each free surface associated with each ejector is substantially equal and zero.

9. The system as in claim 8 wherein said input manifold has an elongated opening coextensive with said ejectors and a total fluidic resistance defined between said first end and said second end;

said output manifold has an elongated opening coextensive with said ejectors and a total fluidic resistance defined between said output manifold first end and said second end; and said transverse conduit is coupled to all of said ejectors and connected to said input manifold and said output manifold elongated openings, said transverse conduit having a total fluidic resistance defined between said input manifold elongated opening and said output manifold elongated opening, said transverse conduit total fluidic resistance being much larger than said input manifold total fluidic resistance and said output manifold total fluidic resistance;

whereby any ink flow velocity component in said transverse conduit along said ejector axis is minimized.

10. The system as in claim 9 wherein said first and second predetermined pressures have a difference such that liquid ink flow in said system is laminar.

11. The system as in claim 9 wherein said input manifold, output manifold and transverse conduit have cross-sections, said cross-sections of said input and output manifolds being constant and large relative to said cross-section of said transverse conduit.

12. The system as in claim 1! wherein said cross-sections of said input and output manifolds are equal to each other.

13. The system as in claim 8 wherein said input manifold second end is connected to said first liquid ink source at first predetermined pressure, said output manifold second end connected to said second liquid ink source at said second predetermined pressure, whereby variations in liquid ink flow rates through said system are reduced.

14. The system as in claim 8 further comprising a plurality of transverse conduits, each conduit coupled to one of said ejectors and connected to said input manifold and said output manifold.

15. The system as in claim 14 wherein said first and second predetermined pressures have a difference such that liquid ink flow in said system is laminar.

16. The system as in claim 14 wherein said input manifold, output manifold and transverse conduits have cross-sections, said cross-sections of said input and output manifolds being constant and large relative to said cross-sections of said transverse conduits.

17. The system as in claim 16 where said cross-sections of said input and output manifolds are equal to each other.

18. In an acoustic ink printer having a plurality of ejectors aligned in an array of rows and columns, each ejector associated with a free surface of liquid ink, said ejector radiating acoustic pressure upon said free surface to eject individual ink droplets on demand, a system for transporting ink under flow constantly to said free surfaces comprising:

a primary input manifold parallel to said ejector rows, said manifold having a first end connected to a first ink supply source at a first predetermined pressure and having a plurality of openings, each opening corresponding to one of said ejector columns, said manifold having a predetermined fluidic resistance between each of two adjacent openings;

a plurality of secondary input manifolds, each input manifold associated with one of said ejector columns and parallel thereto, said input manifold having a first end connected to said primary input manifold opening associated with said ejector column, said input manifold having a plurality of openings corresponding to one ejector in said ejector column, said input manifold having a predetermined fluidic resistance between each of two adjacent openings;

a primary output manifold parallel to said ejector rows, said manifold having a first end adjacent said primary input manifold first end connected to a second ink supply source at a second predetermined pressure equal in magnitude but opposite in sign to said first predetermined pressure, said primary input manifold having a plurality of openings, each opening corresponding to one of said ejector columns, said manifold having a predetermined fluidic resistance between each two adjacent openings, each fluidic resistance between said two adjacent primary output manifold openings being equal to said fluidic resistance between said two primary input manifold openings corresponding to said two adjacent primary output manifold openings;

a plurality of secondary output manifolds, each output manifold associated with one of said ejector columns and parallel thereto, said output manifold having a first end adjacent said first end of said secondary output manifold associated with said one ejector column, said secondary output manifold first end connected to said primary output manifold opening associated with said ejector column, said output manifold having a plurality of openings corresponding to one ejector in said ejector column, said output manifold having a plurality of predetermined fluidic resistances between two adjacent openings, each fluidic resistance between said two adjacent secondary output manifold openings being equal to said fluidic resistance between said two secondary input manifold openings corresponding to said two adjacent secondary output manifold openings; and a plurality of transverse conduits, each transverse conduit coupled to one of said ejectors and connected to said secondary input manifold opening and to said secondary output manifold opening corresponding to said ejector, said transverse conduit having an opening defining said free surface associated with said ejector, said conduit having a predetermined input fluidic resistance between said input manifold opening and said transverse conduit opening, and a predetermined output fluidic resistance between said conduit opening and said output manifold opening, said input and output fluidic resistances being equal to each other;

whereby hydrostatic gauge pressure at the surface of each free surface is substantially equal and zero.

19. The system as in claim 18 wherein said fluidic resistances of said primary and secondary, input and output manifolds are greater than said input and output transverse conduit fluidic resistances.

20. The system as in claim 19 wherein said primary and secondary, input and output manifolds and transverse conduits have cross-sections, said cross-sections of said primary and secondary, input and output manifolds being constant and large relative to said cross-sections of said transverse conduits.

21. The system as in claim 20 wherein said cross-sections of said secondary input and output manifolds are equal to each other.

22. The system as in claim 21 wherein said cross-sections of said transverse conduits are equal to each other.

23. The system as in claim 18 wherein said first and second predetermined pressures have a difference such that liquid ink flow in said system is laminar.

24. The system as in claim 18 wherein said primary input manifold has a second end opposite to said first end, said second end connected to said first liquid ink source, and said primary output manifold has a second end opposite said primary output manifold first end and adjacent said primary input manifold second end, said primary output manifold second end connected to said second liquid ink source, whereby variations in liquid ink flow rates through said system are reduced.

25. The system as in claim 18 further comprising a second primary input manifold parallel to said ejector rows, said manifold having a first end connected to said first ink supply source and having a plurality of openings, each opening corresponding to one of said ejector columns, said manifold having a plurality of predetermined fluidic resistances between two adjacent openings;

a second primary output manifold parallel to said ejector rows, said manifold having a first end adjacent said second primary input manifold first end connected to said second ink supply source, said primary input manifold having a plurality of openings, each opening corresponding to one of said ejector columns, said manifold having a plurality of predetermined fluidic resistances between two adjacent openings, each fluidic resistance between said two adjacent primary output manifold openings being equal to said fluidic resistance between said two second primary input manifold openings corresponding to said two adjacent second primary output manifold openings; and wherein each of said secondary input manifold has a second end opposite said secondary input manifold first end, said second end connected to said second primary input manifold opening associated with said ejector column; and each of said secondary output manifold has a second end opposite said secondary output manifold first end and adjacent said secondary input manifold second end, said second end connected to said second primary output manifold opening associated with said ejector column;

whereby variations in liquid ink flow rates through said system are reduced.

26. The system as in claim 25 wherein said primary input manifold has a second end opposite said first end, said second end connected to said first liquid ink source;

said second primary input manifold has a second end opposite said first end, said second end connected to said first liquid ink source;

said primary output manifold has a second end opposite said primary output manifold first end and adjacent said primary input manifold second end, said primary output manifold second end connected to said second liquid ink source; and said second primary output manifold has a second end opposite said primary output manifold first end and adjacent said primary input manifold second end, said second primary output manifold second end connected to said second liquid ink source;

whereby variations in liquid ink flow rates through said system are reduced.

27. In an acoustic ink printer having a plurality of ejectors aligned in an array of rows and columns, each ejector associated with a free surface of liquid ink, said ejector radiating acoustic pressure upon said free surface to eject individual ink droplets on demand, a system for transporting ink under flow constantly to said free surfaces comprising:

a primary input manifold parallel to said ejector rows, said manifold having a first end connected to a first ink supply source at a first predetermined pressure and having a plurality of openings, each opening corresponding to one of said ejector columns, said manifold having a predetermined fluidic resistance between each of two adjacent openings;

a plurality of secondary input manifolds, each input manifold associated with one of said ejector columns and parallel thereto, said input manifold having a first end and a second end opposite said first end, said first end connected to said primary input manifold opening associated with said ejector column;

a primary output manifold parallel to said ejector rows, said manifold having a first end adjacent said first input manifold first end connected to a second ink supply source at a second predetermined pressure equal in magnitude but opposite in sign to said first predetermined pressure, said primary output manifold having a plurality of openings, each opening corresponding to one of said ejector columns, said manifold having a predetermined fluidic resistance between each of two adjacent openings, each fluidic resistance between said two adjacent primary output manifold openings being equal to said fluidic resistance between said two primary input manifold openings corresponding to said two adjacent primary output manifold openings;

a plurality of secondary output manifolds, each output manifold associated with one of said ejector columns and parallel thereto, said output manifold having a first end and a second end opposite said first end, said first end adjacent said first end of said secondary input manifold associated with said ejector column, said secondary output manifold first end connected to said primary output manifold opening associated with said ejector column; and a transverse conduit coupled to at least one of said ejectors in said ejector column and connected to said secondary input manifold and to said secondary output manifold associated with said ejector column, said transverse conduit having at least one opening defining said free surface associated with said ejector;

said secondary input manifold having a fluidic resistance defined between said first end and said transverse conduit, said secondary output manifold having a fluidic resistance defined between said first end, said transverse conduit having input and output fluidic resistances, said input fluidic resistance defined between said input manifold and said opening, said output fluidic resistance defined between opening and said output manifold, the sum of said input manifold fluidic resistance and said transverse conduit input fluidic resistance being equal to the sum of said output manifold fluidic resistance and said transverse conduit output fluidic resistance;

whereby hydrostatic gauge pressure at the surface of each free surface is substantially equal and zero.

28. The system as in claim 27 wherein each of said secondary input manifolds has an elongated opening co-extensive with said associated ejector column and a total fluidic resistance defined between said first end and said second end;

each of said secondary output manifolds has an elongated opening co-extensive with said associated ejector column and a total fluidic resistance defined between said output manifold first end and said second end; and said transverse conduit is coupled to all of said ejectors of said ejector column and connected to said secondary input manifold and said secondary output manifold elongated openings, said transverse conduit having a total fluidic resistance defined between said input manifold elongated opening and said output manifold elongated opening, said transverse conduit total fluidic resistance being much larger than said secondary input manifold total fluidic resistance and said secondary output manifold total fluidic resistance;

whereby any ink flow in said transverse conduit along said ejector axis is minimized.

29. The system as in claim 28 wherein said first and second predetermined pressures have a difference such that liquid ink flow in said system is laminar.

30. The system as in claim 29 wherein said secondary input manifold, secondary output manifold and transverse conduit have cross-sections, said cross-sections of said input and output manifolds being constant and large relative to said cross-section of said transverse conduit.

31. The system as in claim 30 wherein said cross-sections of said secondary input and output manifolds are equal to each other.

32. The system as in claim 27 wherein said primary input manifold has a second end opposite to said first end, said second end connected to said first liquid ink source, and said primary output manifold has a second end opposite said primary output manifold first end and adjacent said primary input manifold second end, said primary output manifold second end connected to said second liquid ink source, whereby variations in liquid ink flow rates through said system are reduced.

33. The system a in claim 27 further comprising a second primary input manifold parallel to said ejector rows, said manifold having a first end connected to said first ink supply source and having a plurality of openings, each opening corresponding to one of said ejector columns, said manifold having a plurality of predetermined fluidic resistances between two adjacent openings;

a second primary output manifold parallel to said ejector rows, said manifold having a first end adjacent said second primary input manifold first end connected to said second ink supply source, said primary input manifold having a plurality of openings, each opening corresponding to one of said ejector columns, said manifold having a plurality of predetermined fluidic resistances between two adjacent openings, each fluidic resistance between said two adjacent primary output manifold openings being equal to said fluidic resistance between said two second primary input manifold openings corresponding to said two adjacent second primary output manifold openings; and wherein each of said secondary input manifold has a second end opposite said secondary input manifold first end, said second end connected to said second primary input manifold opening associated with said ejector column, and each said secondary output manifold has a second end opposite said secondary output manifold first end and adjacent said secondary input manifold second end, said second end connected to said second primary output manifold opening associated with said ejector column, whereby variations in liquid ink flow rates through said system are reduced.

34. The system as in claim 33 wherein said primary input manifold has a second end opposite said first end, said second end connected to said first liquid ink source;

said second primary input manifold has a second end opposite said first end, said second end connected to said first liquid ink source;

said primary output manifold has a second end opposite said primary output manifold first end and adjacent said primary input manifold second end, said primary output manifold second end connected to said second liquid ink source; and said second primary output manifold has a second end opposite said primary output manifold first end and adjacent said primary input manifold second end, said second primary output manifold second end connected to said second liquid ink source;

whereby variations in liquid ink flow rates through said system are reduced.

* * * * *